US006186641B1

(12) United States Patent
Parker

(10) Patent No.: US 6,186,641 B1
(45) Date of Patent: Feb. 13, 2001

(54) FLASHLIGHT AND CHARGING SYSTEM

(75) Inventor: David Parker, Torrance, CA (US)

(73) Assignee: Pelican Products, Inc., Torrance, CA (US)

( * ) Notice: Under 35 U.S.C. 154(b), the term of this patent shall be extended for 0 days.

(21) Appl. No.: 09/345,187

(22) Filed: Jun. 30, 1999

(51) Int. Cl.[7] ..... F21L 13/00

(52) U.S. Cl. ..... 362/183; 362/194; 362/197; 362/202; 362/203

(58) Field of Search ..... 362/183, 202, 362/197, 199, 203, 194, 204, 205, 208

(56) References Cited

U.S. PATENT DOCUMENTS

| | | | |
|---|---|---|---|
| D. 282,289 | | 1/1986 | Verdier . |
| D. 351,675 | | 10/1994 | Sharrah et al. . |
| D. 353,216 | | 12/1994 | Sharrah et al. . |
| D. 394,122 | | 5/1998 | Concari et al. . |
| 1,680,169 | | 8/1928 | Osean . |
| 2,016,819 | | 10/1935 | Meginniss . |
| 2,097,222 | | 10/1937 | Tompkins et al. . |
| 2,272,907 | | 2/1942 | Deibel . |
| 2,312,463 | | 3/1943 | Zdansky . |
| 2,339,356 | | 1/1944 | Sachs . |
| 2,418,759 | * | 4/1947 | Crimmins ..... 362/204 |
| 2,813,265 | | 11/1957 | Finks . |
| 2,931,005 | | 3/1960 | Saurwein et al. . |
| 2,945,944 | | 7/1960 | Gillespie . |
| 3,217,224 | | 11/1965 | Sherwood . |
| 3,659,180 | | 4/1972 | Urbush . |
| 3,787,678 | | 1/1974 | Rainer . |
| 3,825,740 | | 7/1974 | Friedman et al. . |
| 3,829,676 | | 8/1974 | Nelson et al. . |
| 4,060,723 | | 11/1977 | Nelson . |
| 4,092,580 | | 5/1978 | Prinsze . |
| 4,171,534 | | 10/1979 | Strowe . |
| 4,203,150 | | 5/1980 | Shamlian . |
| 4,225,814 | | 9/1980 | Gantz et al. . |
| 4,265,984 | | 5/1981 | Kaye . |
| 4,286,311 | | 8/1981 | Maglica . |
| 4,325,107 | | 4/1982 | MacLeod . |
| 4,345,304 | | 8/1982 | Penney et al. . |
| 4,388,673 | * | 6/1983 | Maglica ..... 362/183 |
| 4,463,283 | | 7/1984 | Penney et al. . |
| 4,472,766 | | 9/1984 | Hung . |
| 4,495,551 | | 1/1985 | Foltz . |
| 4,819,141 | | 4/1989 | Maglica et al. . |
| 4,843,298 | | 6/1989 | Brauch et al. . |
| 4,843,526 | | 6/1989 | Price, III . |
| 4,870,550 | | 9/1989 | Uke . |
| 4,888,670 | | 12/1989 | Sharrah . |
| 4,899,265 | | 2/1990 | Maglica . |
| 4,942,505 | | 7/1990 | Maglica . |
| 4,970,073 | | 11/1990 | Arzur et al. . |
| 5,008,785 | | 4/1991 | Maglica et al. . |
| 5,165,048 | | 11/1992 | Keller et al. . |
| 5,171,086 | | 12/1992 | Baloochi . |
| 5,432,689 | | 7/1995 | Sharrah et al. . |
| 5,486,432 | | 1/1996 | Sharrah et al. . |

FOREIGN PATENT DOCUMENTS

| | | |
|---|---|---|
| 0 768 724 A2 | 4/1997 | (EP) . |
| 0 679 237 B1 | 9/1997 | (EP) . |
| 2 372 382 | 11/1976 | (FR) . |
| 411218 | 6/1934 | (GB) . |

* cited by examiner

*Primary Examiner*—Sandra O'Shea
*Assistant Examiner*—Bertrand Zeade
(74) *Attorney, Agent, or Firm*—Oppenheimer, Wolff & Donnelly LLP

(57) ABSTRACT

A flashlight includes a rechargeable battery and is loaded from the front. The contacts are on an intermediate portion between the barrel extended and made with contacts of a recharging device. There is a helical spring member between the switching device above the barrel and the top of the battery and a helical spring member on the base of the barrel at the bottom of the battery. An enlarged head is located above the barrel and there is the intermediate portion between the head and the barrel. The intermediate portion receives the switching device.

25 Claims, 2 Drawing Sheets

FLASHLIGHT AND CHARGING SYSTEM

RELATED APPLICATIONS

This application relates to patent application Nos. 09/343,570 filed contemporaneously with this application, entitled "FLASHLIGHT AND CHARGER" and 09/343,571 filed contemporaneously with this application, entitled "CHARGEABLE FLASHLIGHT". The contents of these applications are incorporated by reference herein.

BACKGROUND OF THE INVENTION

This invention relates to a rechargeable flashlight. In particular, it relates to a flashlight for use in relatively rugged conditions.

Many flashlight configurations are known. Additionally, different flashlight configurations are known which are rechargeable. There are also different forms of recharging device for use with flashlights. The different combinations provide for a configuration of flashlight and recharging mechanism, which is not as optimum as possible in the sense that the flashlight and recharger can be easily set up as a unit. Moreover, they are not convenient for rugged use, for instance, by law enforcement officers, the military and firefighters.

The various flashlights are often not as simple and inexpensive to manufacture as desirable, while at the same time having effective characteristics of longevity and ability to work in harsh conditions and being subjected to shock, and the need for quick recharging as necessary.

The invention is directed to providing a flashlight and recharging system which minimizes the disadvantages of known flashlights.

SUMMARY OF THE INVENTION

By the present invention, there is provided a flashlight which minimizes the disadvantages of known flashlights.

A rechargeable battery flashlight is provided with a body portion being the barrel, an intermediate section and a head. The flashlight is loaded with batteries from the front. There are contacts on an intermediate portion above the barrel opposite to a switch device in the intermediate portion. A helical spring is loaded at the top of the battery and another helical spring is at the bottom of the battery to retain the battery in a shock-absorbing mode. The helical spring at the bottom is located between the contact strip at the base of the barrel and the battery, and is in electrical contact with the battery. The helical spring at the top is located between the battery and a switching device, which is transversely mounted in an intermediate section above the barrel of the flashlight. The top helical spring is in electrical contact. Above the intermediate section is located an enlarged head which includes a lens and a bulb.

A recharger is provided to connect with the contacts on the intermediate portion when in recharging mode. The recharger device includes arms or jaws which preferably engage the flashlight around the barrel so that the contacts on the recharger can make electrical contact with the contacts on the intermediate portion of the flashlight.

The invention is further described with reference to the accompanying drawings.

DETAILED DESCRIPTION OF THE PREFERRED EMBODIMENT

Figure 1:
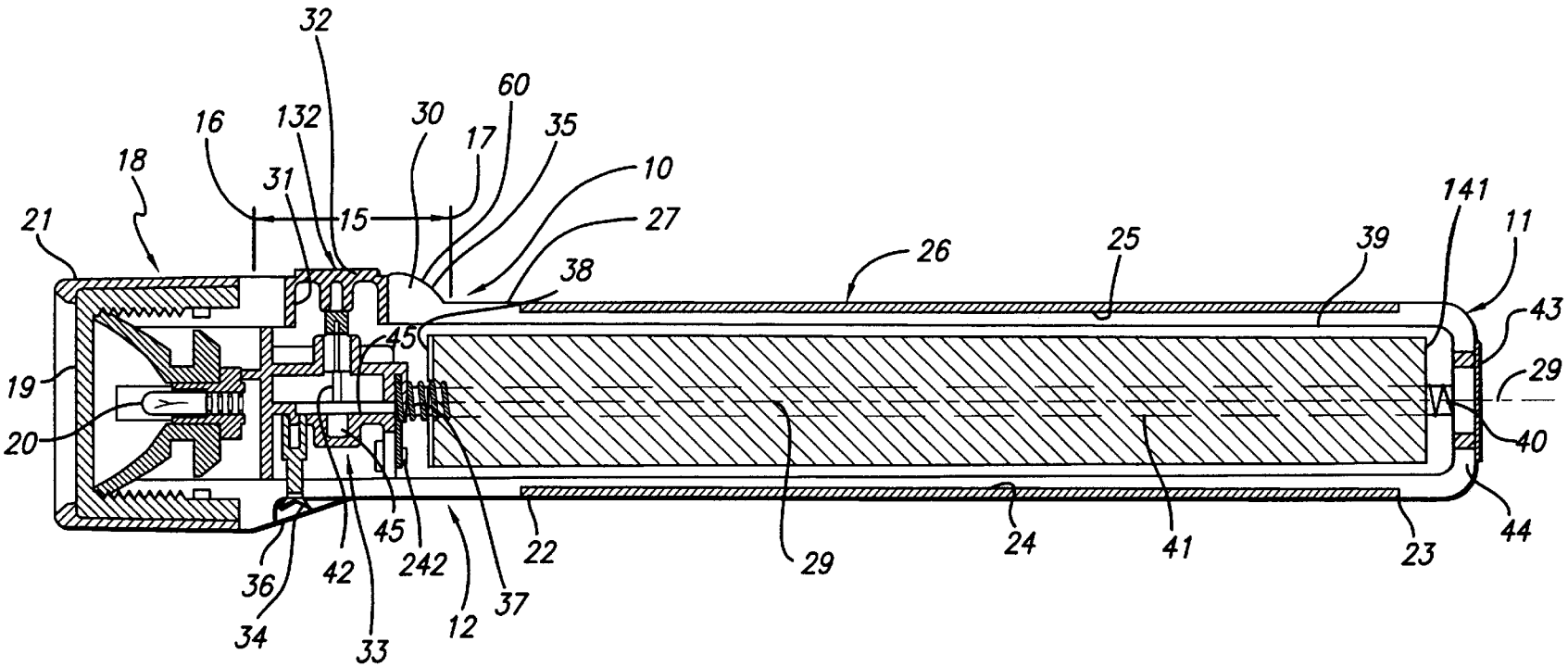
FIG. 1 is a cross-sectional view of a flashlight in accordance with the invention showing the body which includes the barrel and intermediate section and an enlarged head above the intermediate section. The battery is shown in the barrel.

A rechargeable flashlight including a body 10 which has a substantially regular first cross-sectional area as defined between the base 11 of the body 10 and the top portion of the body as defined in the area 12. The first cross-sectional area is defined on the outside by an octagonal configuration 13 and the internal configuration is formed substantially as a circular structure 14. The body 10 includes a barrel.

Above the body portion 10 there is an intermediate portion 15 defined by a second cross-sectional area. The intermediate portion 15 is defined between the ends 16 and 17 of the arrows show in FIG. 1. Above the intermediate portion 15 there is a head portion 18 which is relatively enlarged. The intermediate portion 15 includes a protrusion 60 on one side, namely one of the octagonal sides of the flashlight. The protrusion is for housing in part, a switching device.

The head portion 18 includes a lens 19 and within the lens a bulb 20. There is also located a shroud 21 which is over-molded on the lens 19. This provides increased protection to the lens 19.

The body portion 10 outside surface octagonal configuration includes two circumferential lips 22 and 23. Lip 22 is located substantially at the uppermost portion of the body portion 10 around the outside. The lip 23 is located towards the base portion 11 around the outside of the body portion 10. These inset lips provide a receiving area 24 for receiving an extruded resilient, flexible and stretchable sleeve 25, which can fit within the circumferential trough, formed between the lips 22 and 23. The outside surface 26 of the sleeve 25 is substantially flush with the outside surface 27 of the body portion 10 when in position between the lips.

The intermediate portion 15 has a second cross-sectional area, which is relatively larger than the first cross-sectional area of the body portion 10. The second cross-sectional areas extends relatively to one side of the longitudinal axis 29 running through the body portion 10, and it is this extended portion 60 which acts to receive the switching device.

At the extended portion 15 there is provided a transverse aperture 31 through which a manually operable movable switching arm or tower and push button 132 of the switch device or assembly 33 is located. A switch pad button cover 132 is provided to the movable arm 32. The manually operable switch arm 32 can be depressed to activate the spring operated switch assembly 33 so as to close and open electrical contacts in the switch device 33. The opposite end of the switch device 33 is connected with electrical contacts 34, which are mounted as a pair adjacent each other transversely in the extended portion 15 of the body, namely the intermediate portion below the head 18. Connecting the extended protrusion 60 of the intermediate portion 15 with the body portion 10, there is a relatively tapered zone 35. Connecting the extended intermediate portion 15 with the head potion 18, there is also a tapered zone 36. The head portion 18 is formed such as to have a relatively greater cross-section that the cross-section than the intermediate portion 15. The location of the enlarged portion 18 is relatively centrally formed relative to the longitudinal axis 29.

The trailing end of the switch device assembly 33 includes a helical spring 37, which is directed downwardly towards a top portion 38 of battery 39. There is a helical spring 40 mounted at the base area 11 of the body and is directed to the base 141 of the battery 39. As such, the two helical springs 37 and 40 are in opposition to each other, and thereby suspend the battery 39 between the springs in a shock-absorbing configuration. Spring 40 is in electrical contact with the battery, and its opposite side is in electrical contact with a terminal of the switch device 33. Spring 37 is ("not" delete) in electrical contact with the battery 39. Spring 40 is in electrical contact with the battery 39.

There is also a contact strip 41 which connects with the helical spring 40 and runs up the inside face of the body 10, and electrically connects with the switch assembly 33 appropriately. The strip runs outside the battery 39 and at the top in the area of the enlarged head engages one contact of the bulb 20 through an engagement with the back of the reflector of the bulb-lens assembly. The completion of the electric circuit is made by a contact from the switch assembly 33 to the base of the bulb 20.

Thus, when the operational arm and push button 132 of the switch 33 acts to press and depress the plunger mechanism 42 of the switch device assembly 33, the circuit connecting the battery 39 between the bulb 20 is made or broken through the switch device assembly 33 and electrical contacts within the switch device assembly 33. The operation of the switch assembly 33 is transverse or relatively radial to the longitudinal axis 29 of the body of the flashlight. The operational arm and push button 32 and the plunger 42 acts relatively radially or transversely in relation to axis 29 and the operational arm and push button 32 is relatively located in a radially opposite position to the contacts 34 on the flashlight.

The switch assembly 33 include the plunger 42 which operates with one or more springs 45 which are helically and coaxialing mounted around the plunger 42. Suitable contacts 45 are provided for opening and closing and making the flashlight circuit between the battery 39 and the bulb 20.

A suitable button padding 132 is provided to the arm 32 such as to provide for positive engagement by finger operation of a user. The outside of the flashlight therefore has the extruded sleeve 25, a suitable padding on the operational button and a shroud 21 around the lens. Thus, the outside of the flashlight is suitably protected for rugged use. Within the flashlight mechanism as indicated, the battery is suitably buffered for shock between the springs 37 and 40.

The operation of the switch assembly 33 in a manner transverse to the longitudinal direction of the flashlight also provides for effective and positive movement. By locating the switch 33 in the intermediate section of the flashlight, there is greater width and cross-sectional area to accommodate the switch device 33 in a convenient place. Having the location of the switch 33 radially opposite the contacts 34 also provides for an effective assembly and location of these two components. At the base 11 of the body 10, there is a plug 43 which fits into an aperture 44 in the base of the body 10. The plug 43 is also formed of a relatively resilient material so as to provide for protection at the base zone of the flashlight.

Figure 2:
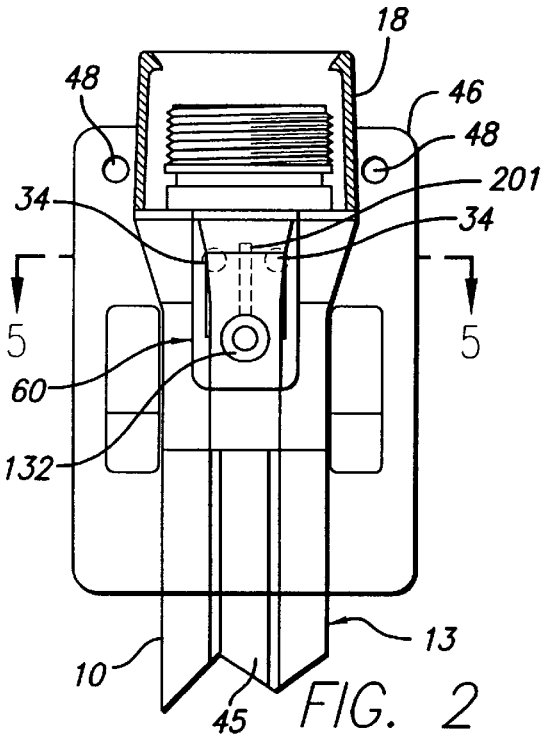
FIG. 2 is a top view of a portion of the flashlight located with a recharging device, the recharging device having jaws which are engaged with the barrel of the flashlight.
Figure 3:
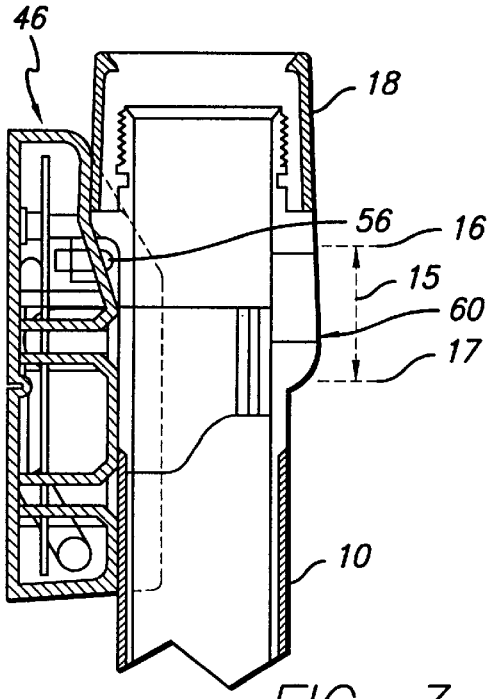
FIG. 3 is a cross-sectional side view of a portion of the flashlight shown with a recharging device.
Figure 4:
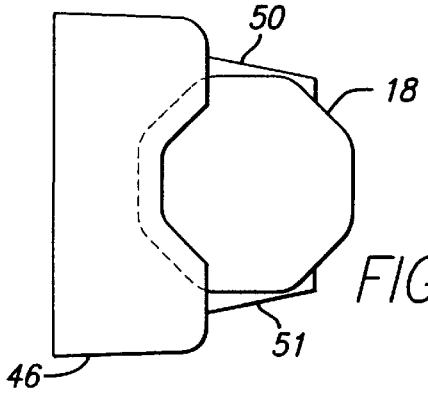
FIG. 4 is a view from the front of the combination of the flashlight and recharger.
Figure 5:
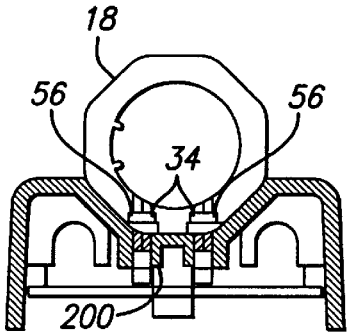
FIG. 5 is a view along line 5—5 showing the flashlight connected with the contacts of the recharger without the jaws of the recharger.

As shown in FIG. 2 the two contacts 34 are transversely adjacently located relative to each other on one face of the octagonal surface 13 of the body 10. The operating button 32 of the switch device 33 is shown in the front on the panel 45 of the body 10. It is an opposite face to the face having the contacts 34.

Figure 6:
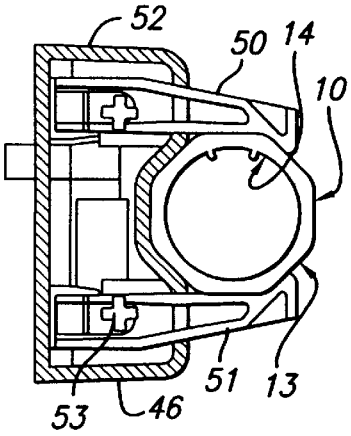
FIG. 6 is a cross-sectional view showing the recharger connected with the flashlight and the jaws of the recharger anchored around the body of the flashlight.
Figure 7:
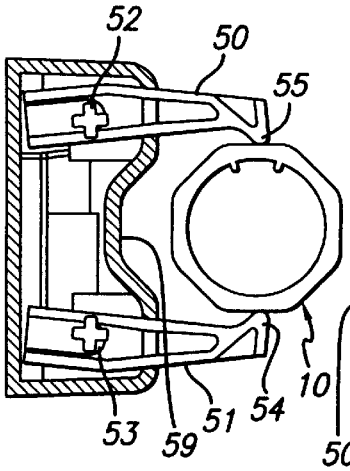
FIG. 7 is a cross-sectional view showing the jaws of the recharger opened about respective pivot points as the flashlight is located at the tips of the end of the jaws.
Figure 8:
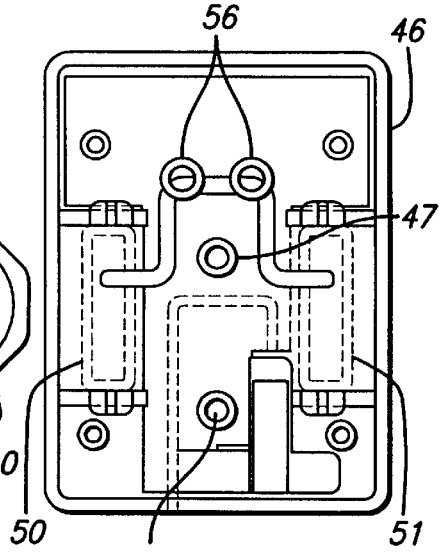
FIG. 8 is a rear view of the recharger unit.

The recharger device includes a mounting plate 46 which has two mounting holes 47, 49 for mounting the recharger 46 on a suitable base. The recharger 46 includes two articulating arms or, jaws 50 and 51, which are pivotably mounted to articulate relatively above pivots 52 and 53. The mounting pivots 52 and 53 are of a spring nature and the tip 54 of arm 51 and tip 55 of arm 50 engage the outer surface of the body 10 of the flashlight. A suitable spring acts to cause the articulating arms 50 and 51 to be urged inwardly towards the engaging position as shown in FIG. 6. When the arms 50 and 51 are open as shown in FIG. 7, it is against the spring action and this allows the flashlight to enter into the position whereby the contacts 34 can engage mating contacts 56 which extend outwardly from the recharger member.

The articulating arms 50 and 51 engage the body portion 10 below the intermediate section 15 of the flashlight. The contacts 56 are located on the recharger 46 so they engage the contacts 34 which are also positioned at the intermediate section 15 of the flashlight. The contacts are spring mounted to be urged outwardly to engage the contacts 34. The recharger 46 includes conventional circuitry to act as a recharger. It can be set up for connection with 120 volt main supply or 12 volt DC supply. LEDS 48 indicate the operational condition of the recharger and flashlight.

By having the tips 54 and 55 engage the body of the flashlight in the area 10, namely below the intermediate section 15, the tips and the respective arms 50 and 51 do not have to open and close over a larger diameter. The ends of the tips 54 and 55 are shaped to conform with the octagonal formation of the outside surface of the body 10. This permits for engagement in an embracing manner with the body 10. The inside surface 59 of the recharger 46 also provides a mating interface with the octagonal surface 13. As can be seen therefore in FIG. 6, the combination of the mating surface 59 on the body of the recharger 46 and the shapes of the arms 50 and 51 are such that seven sides of the hexagonal formation 13 are embraced when the body 10 is in position properly in the recharger 46. This permits for a firm location of the flashlight 10 in the recharger 46 when recharging is to be affected.

Many other forms of the invention exist, each differing from the other in matters of detail only.

For instance, instead of having the contacts 34 located on the intermediate portion 10, namely below the head 18, it is possible to have a configuration where the contacts are on the body portion, namely the narrower body portion 10. In other cases, the recharging device may be formed with a mechanism different to the articulating jaws. Only one jaw may articulate, and the other may be stationary in some situations.

In yet different configuration, instead of having the shock-absorbing sleeve extruded around the body 10, the body 10 itself may be formed from material sufficiently sturdy to be resilient to shock. Instead of a plug 44, a different configuration can be used, one for instance, where the plug is integrated or formed as a solid member as part of a whole base portion for the body 10. Likewise, there can be situations without a shock-absorbing shroud around the lens. Instead of helical springs on either side of the rechargeable battery which can be of a nickel-cadmium configuration, there can be different spring formations to provide effective shock absorbing characteristics to either side of the battery.

There is also provided a centering protrusion 200 in the face of the recharger 46 for mating with a slot 201 running vertically in the flashlight. This slot and protrusion can be located between the respective contacts 34 and they facilitate alignment of the flashlight in the recharger 46.

Generally, the configuration of the components is of the nature that the units are relatively water impermeable and, in this manner, the configuration of the components are tight fitting and of a material such that the ingress of water into the inner workings and compartments of the battery is relatively difficult under normal and even relatively rugged working conditions.

The invention is to be determined solely upon the following claims.

What is claimed is:

1. A rechargeable flashlight comprising:

a body for receiving a rechargeable battery, the body having a longitudinal axis and a top and a base;

a head on the body having a lens and a bulb;

contacts below the head for making connection with contacts on a recharger device;

a switch device with electrical contacts, the switch device being between the body and the head portion, the switch device acting to move radially inwardly and outwardly relative to the longitudinal axis of the body to open and close an electric circuit between the battery and the bulb;

a first spring extending from the switch device to the battery top;

a second spring between the battery bottom and a base of the body;

an electrical connection between the battery base and the electrical contacts of the switch device; and the springs acting to provide a shock absorbing effect to either side of the battery.

2. A flashlight as claimed in claim 1 wherein the body includes a barrel having a first cross-section and above the barrel there is a portion extending with a second larger cross-section, and above the portion over the second larger cross-section there is a portion with a third larger cross-section, the third larger cross-section being the head on the body.

3. A flashlight as claimed in claim 2 wherein the portion having a second larger cross-section extends generally to one side of the longitudinal axis and on the opposite side of the longitudinal axis, and wherein the head extends substantially equally around the longitudinal axis.

4. A flashlight as claimed in claim 2 wherein a second portion includes an outwardly tapered section starting between the top and a bottom of the second portion, and extending to the head portion and there is an outwardly tapered portion extending from about the base of the second portion to the outside perimeter of the top of the barrel.

5. A flashlight as claimed in claim 1 wherein the body includes a resilient sleeve over an outer portion of the body.

6. A flashlight as claimed in claim 5 wherein the outside surface of the body includes a recessed lip for accommodating the sleeve such that the sleeve is an outside surface which is substantially flush with the surface of the body beyond the sleeve.

7. A flashlight as claimed in claim 2 wherein the second portion is for receiving the switch device such that a manually operable portion of the switch device extends through a radial aperture and wherein the switch device is operable radially inwardly and outwardly to activate and deactivate the switch.

8. A flashlight as claimed in claim 1 wherein the contacts for connection to the rechargeable device are on the flashlight on an intermediate portion above the body and below the head.

9. A flashlight as claimed in claim 1 wherein the flashlight is front-loaded with the rechargeable battery.

10. A flashlight as claimed in claim 1 wherein the switch device includes a manually operable switch extending transversely radially from one side of the flashlight and wherein the contacts extend from the opposite side of the flashlight, and wherein the contacts are essentially a pair of two discreetly spaced point contacts, the contacts not extending around the periphery of the body.

11. A flashlight as claimed in claim 1 including a contact strip extending between the base of the body and the switch device, the contact strip acting to electrically connect a base of the battery with the switch device.

12. A flashlight as claimed in claim 1 wherein the first spring includes a helical spring extending downwardly from the switch device to the top of the battery and wherein the second spring is a helical spring extending upwardly from the base of the body to the battery, and both of the springs being part of an electrical circuit between the battery and the bulb.

13. A flashlight as claimed in claim 1 wherein the barrel includes an open end at the base, the open end being filled with a resilient plug member.

14. A rechargeable flashlight comprising:

a body for receiving a rechargeable battery, the body having a longitudinal axis and a top and a base;

a head on the body having a lens and a bulb;

contacts below the head for making connection with contacts on a recharger device;

a switch device with electrical contacts, the switch device being between the body and the head portion, the switch device acting to move radially inwardly and outwardly relative to the longitudinal axis of the body to open and close an electric circuit between the battery and the bulb;

a first spring extending downwardly from the switch device to the battery top and a second spring between the battery bottom and a base of the body, and an electrical connection between the battery base and the electrical contacts of the switch device;

the body including a barrel having a first cross-section and above the barrel there is a portion extending with a second larger cross-section, and above the portion over the second larger cross-section there is a portion with a third larger cross-section, the third larger cross-section being the head on the body;

the second portion receiving the switch device; and wherein the contacts of the flashlight are on an intermediate portion above the body and below the head.

15. A flashlight as claimed in claim 14 wherein the flashlight is front loaded with the rechargeable battery.

16. A flashlight as claimed in claim 15 wherein the first spring includes a helical spring extending downwardly from the switch device to the top of the battery and wherein the second spring is a helical spring extending upwardly from the base of the body to the battery, at least one of the springs being part of an electrical circuit between the battery and the bulb, a contact strip acting to electrically connect a base of this battery with the switch device, and wherein the body is not part of the electrical circuit.

17. A rechargeable flashlight comprising:

a body for receiving a rechargeable battery, the body having a longitudinal axis and a top and a base;

a head on the body having a lens and a bulb;

contacts below the head for making connection with contacts on a recharger device;

a switch device with electrical contacts, the switch device being between the body and the head portion, the switch device acting to move radially inwardly and outwardly relative to the longitudinal axis of the body to open and close an electric circuit between the battery and the bulb;

a first spring extending from the switch device to the battery top;

a second spring between the battery bottom and a base of the body;

an electrical connection between the battery base and the electrical contacts of the switch device; and the body includes a resilient sleeve over an outer portion of the body, and wherein the outside surface of the body includes a lip for accommodating a portion of the sleeve.

18. A rechargeable flashlight comprising:

a body for receiving a rechargeable battery, the body having a longitudinal axis and a top and a base;

a head on the body having a lens and a bulb;

contacts below the head for making connection with contacts on a recharger device;

a switch device with electrical contacts, the switch device being between the body and the head portion, the switch device acting to move radially inwardly and outwardly relative to the longitudinal axis of the body to open and close an electric circuit between the battery and the bulb;

a first spring extending from the switch device to the battery top;

a second spring between the battery bottom and a base of the body;

an electrical connection between the battery base and the electrical contacts of the switch device; and the body includes a cross section which is regular about a central longitudinal axis and having at least a configuration of more than four sides.

19. A flashlight as claimed in claim 18 wherein the body includes a resilient sleeve over an outer portion of the body, and wherein the outside surface of the body includes a lip for accommodating a portion of the sleeve.

20. A rechargeable flashlight comprising:

a body for receiving a rechargeable battery, the body having a longitudinal axis and a top and a base;

a head on the body having a lens and a bulb;

contacts below the head for making connection with contacts on a recharger device;

a switch device with electrical contacts, the switch device being between the body and the head portion, the switch device acting to move radially inwardly and outwardly relative to the longitudinal axis of the body to open and close an electric circuit between the battery and the bulb;

a first spring extending downwardly from the switch device to the battery top and a second spring between the battery bottom and a base of the body, and an electrical connection between the battery base and the electrical contacts of the switch device;

the body including a barrel having a first cross-section and above the barrel there is a portion extending with a second larger cross-section, and above the portion over the second larger cross-section there is a portion with a third larger cross-section, the third larger cross-section being the head on the body;

the second portion receiving the switch device; and wherein the contacts of the flashlight are on an intermediate portion above the body and below the head, and wherein the contacts also constitute portion of elongated securing means for securing the switch device in position in the flashlight.

21. A rechargeable flashlight comprising:

a body for receiving a rechargeable battery, the body having a longitudinal axis and a top and a base;

a head on the body having a lens and a bulb;

contacts below the head for making connection with contacts on a recharger device;

a switch device with electrical contacts, the switch device being between the body and the head portion, the switch device acting to move radially inwardly and outwardly relative to the longitudinal axis of the body to open and close an electric circuit between the battery and the bulb;

a first spring extending downwardly from the switch device to the battery top and a second spring between the battery bottom and a base of the body, and the switch having a contact or the switch with a central contact of the bulb;

an electrical contact strip connection directed along the side on the inside of the barrel from the battery base to one contact on the side of the bulb;

the body including a barrel having a first cross-section and above the barrel there is a portion extending with a second larger cross-section, and above the portion over the second larger cross-section there is a portion with a third larger cross-section, the third larger cross-section being the head on the body;

the second portion receiving the switch device; and a ring for surrounding the bulb and isolating the side contact strip connection along the side from contact with the central contact of the bulb.

22. A recharger device for operation with a rechargeable flashlight, the flashlight comprising:

a body for receiving a rechargeable battery, the body having a longitudinal axis and a top and a base;

a head on the body having a lens and a bulb;

contacts below the head for making connection with contacts on a recharger device;

a switch device with electrical contacts, the switch device being between the body and the head portion, the switch device acting to move radially inwardly and outwardly relative to the longitudinal axis of the body to open and close an electric circuit between the battery and the bulb;

a first spring extending from the switch device to the battery top;

a second spring between the battery bottom and a base of the body;

an electrical connection between the battery base and the electrical contacts of the switch device; and the recharger device being for receiving the flashlight and including physical elements for securing the flashlight with the contacts in operable recharging connection with the contacts of the flashlight.

23. A recharger device for a rechargeable flashlight, the flashlight comprising:

a body for receiving a rechargeable battery, the body having a longitudinal axis and a top and a base;

a head on the body having a lens and a bulb;

contacts for making connection with contacts on a recharger device;

a switch device with electrical contacts to open and close an electric circuit between the battery and the bulb;

a first spring extending from the switch device to the battery top and a second spring between the battery bottom and a base of the body, and an electrical connection between the battery base and the electrical contacts of the switch device; and the recharger device being for receiving the flashlight and securing the flashlight with the contacts in operable recharging connection with the contacts of the flashlight.

24. A recharger device as claimed in claim 22 wherein the recharger device includes spaced jaws for receiving the body of the flashlight about the portion of the flashlight constituting the body.

25. A recharger device as claimed in claim 22 wherein the recharger device and the flashlight respectively have a mating slot and tongue formation to ensure a positive alignment between the flashlight and the recharger, the recharger including jaws for receiving the body of the flashlight about the portion of the flashlight constituting the body.

* * * * *